US007735799B1

(12) United States Patent
Antici

(10) Patent No.: US 7,735,799 B1
(45) Date of Patent: Jun. 15, 2010

(54) BOOK HOLDING DEVICE

(76) Inventor: Roger Antici, 6458 71st6 St., North, Pinellas Park, FL (US) 33781

( * ) Notice: Subject to any disclaimer, the term of this patent is extended or adjusted under 35 U.S.C. 154(b) by 0 days.

(21) Appl. No.: 12/011,620

(22) Filed: Jan. 28, 2008

(51) Int. Cl.
*A47G 1/24* (2006.01)

(52) U.S. Cl. ..... 248/454; 248/444.1; 248/447.1

(58) Field of Classification Search ..... 248/441.1, 248/444.1, 446, 450, 451, 452, 454
See application file for complete search history.

(56) References Cited

U.S. PATENT DOCUMENTS

| | | | | |
|---|---|---|---|---|
| 397,627 | A | 2/1889 | Brown | |
| 2,481,107 | A | 9/1949 | Gore | |
| 2,627,694 | A | 2/1953 | Saecker | |
| 2,784,929 | A | 3/1957 | Diening | |
| 3,718,308 | A | 2/1973 | Hainault | |
| 4,015,813 | A | 4/1977 | Graham | |
| 4,150,807 | A | 4/1979 | Manso | |
| 4,436,271 | A | 3/1984 | Manso | |
| 4,470,571 | A * | 9/1984 | Hartman | 248/452 |
| 4,512,542 | A | 4/1985 | Black | |
| D327,172 | S | 6/1992 | Pagano | |
| 5,720,466 | A | 2/1998 | Skipper | |
| 5,884,889 | A | 3/1999 | Crosby | |
| 6,196,512 | B1 | 3/2001 | Ure | |
| 6,435,466 | B1 | 8/2002 | Adams | |
| 6,557,811 | B1 | 5/2003 | Burns | |
| 6,776,385 | B1 | 8/2004 | Chang | |
| 6,969,037 | B2 | 11/2005 | Eby et al. | |

* cited by examiner

*Primary Examiner*—J. Allen Shriver, II
*Assistant Examiner*—Erin Smith
(74) *Attorney, Agent, or Firm*—Edward P Dutkiewicz

(57) ABSTRACT

A book holding device comprising a base plate, a pair of book contact plates, and at least one resilient compression end member. The book holding device having an associated removable, fold-able stand coupled to the rear surface of the book holding device.

14 Claims, 6 Drawing Sheets

BOOK HOLDING DEVICE

BACKGROUND OF THE INVENTION

New Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a book holding device and more particularly pertains to a device to hold a book open as well as book storage.

DESCRIPTION OF THE PRIOR ART

The use of devices to hold open books is known in the prior art. More specifically, devices to hold open books previously devised and utilized for the purpose of freeing up a user's hands from holding a book are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe book holding device that allows a device to hold a book open as well as book storage.

In this respect, the book holding device according to the present invention substantially departs from the conventional concepts and designs of the prior art, and in doing so provides an apparatus primarily developed for the purpose of a device to hold a book open as well as book storage.

Therefore, it can be appreciated that there exists a continuing need for a new and improved book holding device which can be used for a device to hold a book open as well as book storage. In this regard, the present invention substantially fulfills this need.

SUMMARY OF THE INVENTION

In view of the foregoing disadvantages inherent in the known types of devices to hold open books now present in the prior art, the present invention provides an improved book holding device. As such, the general purpose of the present invention, which will be described subsequently in greater detail, is to provide a new and improved book holding device and method which has all the advantages of the prior art and none of the disadvantages.

To attain this, the present invention essentially comprises a book holding device comprising several components, in combination. First provided is a base plate. The base plate is made of a rigid material. The base plate has a front side, a back side, an upper end, a lower end, two opposing side ends, and an intermediate planar area. The base plate has a generally rectilinear configuration with the upper end and the lower end. The ends of the base plate are generally mirror image configurations of the other. The base plate lies in a first plane with the upper end and the lower end each having a right angled projection there from. The right angled projection has a first height, a first length, and a first depth. The right angled projection lies in a plane generally perpendicular to the plane of the base plate. The right angled projections of the base plate have a rearward end and a forward end, with each forward end having a inwardly turned lip. The inwardly turned lip of the upper end and the lower end forms an upper trough and a lower trough between the inwardly turned lip. The base plate comprises the two troughs, with each trough having a first length, a first height, and a first depth. The base plate has a generally C-shaped configuration. The dimension between the upward and downward extents of the troughs is between about six inches and eight inches. The side to side dimension is between about four inches and six inches. The distance between the inwardly turned lip and the base plate is between about two inches and four inches.

Next provided is a pair of book contact plates. The book contact plates are an upper contact plate and a lower contact plate. Each plate is fabricated of a rigid material and has a generally rectilinear configuration. Each contact plate lies in a plane parallel with the other contact plate and is perpendicular to the plane of the base plate. Each contact plate has a forward edge and a rearward edge. The rearward edge of each of the contact plates is located adjacent the base plate intermediate area. The contact plates are oriented at about ninety degrees to the base plate. The book contact plates each have a first length and a second depth. The second depth is less than the first depth. Each contact plate lies inwardly of the right angled projections of the base plate. The contact plates each also have an upper end and a lower end and a peripheral edge. Each contact plate has a pair of protuberances. The upper contact plate has a pair of inwardly and downwardly oriented protuberances. The lower contact plate has a pair of inwardly and upwardly oriented protuberances. The lower contact plate protuberances and upper contact plate protuberances are similarly configured and lie in the plane generally parallel with the plane of the base plate.

Next provided is a pair of resilient compression end members. The end members each have a generally rectangular cylindrical configuration with a first length, a second depth, and a second height. The second height is greater than the first height. Each end member has an upper surface, a lower surface, a pair of parallel side surfaces, and a pair of generally parallel end surfaces.

Next provided is an adhesive layer. The adhesive layer couples the resilient compression end members and the angled projection of the base plate.

Next provided is a platform. The platform is fabricated of a rigid material and has a generally flat planar configuration. The platform has a front surface, a back surface, and a thickness there between forming a peripheral edge around the extents of the platform. The platform is sized to fit within the intermediate area of the base plate.

Next provided is a plurality of resilient compression platform mount members. The platform mount members each have a generally rectangular cylindrical configuration with a first length, a first width, and a third depth. The third depth is less than the second depth. Each platform mount member has an upper surface, a lower surface, a front surface, a rear surface, and a pair of generally parallel side surfaces.

Next provided is an adhesive layer. The adhesive layer couples the rear surface of the resilient compression platform mount members and the base plate. An adhesive layer also couples the front surfaces of the compression platform mount members and the platform.

A coupling means as herein use, may be an adhesive layer, clips, snaps, ties, and hook and loop devices.

Next provided is a strip of hook and loop fastener. The strip of hook and loop fastener is coupled to the rear surface of the base plate, in the intermediate area of the rear of the base plate.

Lastly provided is a folded strip of rigid material having associated patches of hook and loop fastener. The folded strip is coupled to the strip of hook and loop fastener located on the rear of the base plate. The folded strip of rigid material acts as a stand or rest for the base plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved book holding device which has all of the advantages of the prior art devices to hold open books and none of the disadvantages.

It is another object of the present invention to provide a new and improved book holding device which may be easily and efficiently manufactured and marketed.

It is further object of the present invention to provide a new and improved book holding device which is of durable and reliable constructions.

An even further object of the present invention is to provide a new and improved book holding device which is susceptible of a low cost of manufacture with regard to both materials and labor, and which accordingly is then susceptible of low prices of sale to the consuming public, thereby making such book holding device economically available to the buying public.

Even still another object of the present invention is to provide a book holding device for a device to hold a book open as well as book storage.

Lastly, it is an object of the present invention to provide a new and improved book holding device comprising a base plate, a pair of book contact plates, and at least one resilient compression end member. The book holding device having an associated removable, fold-able stand coupled to the rear surface of the book holding device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
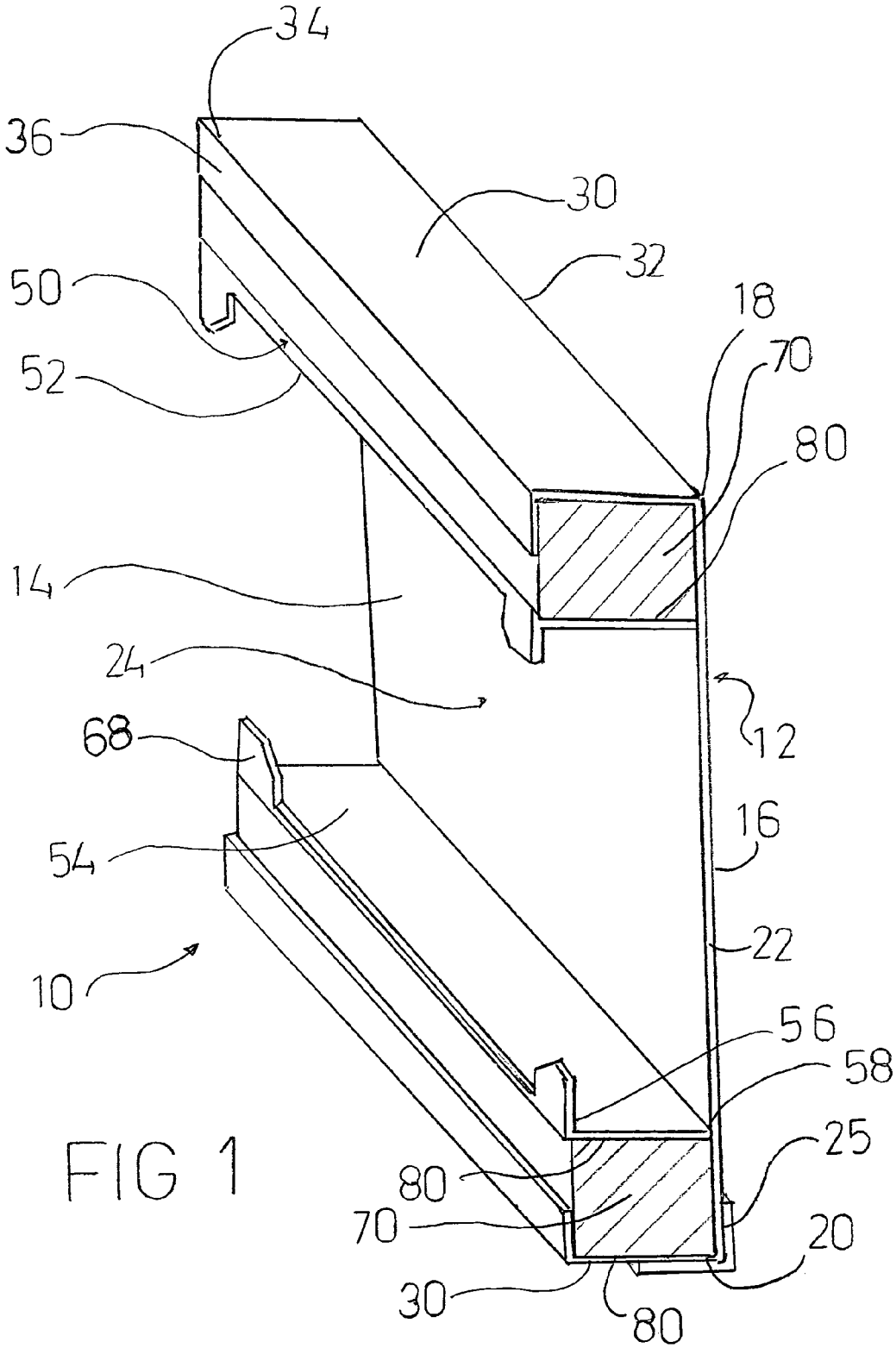
FIG. 1 is perspective view of the book holding device. The platform is absent to show the relationship of the contact plates.
Figure 2:
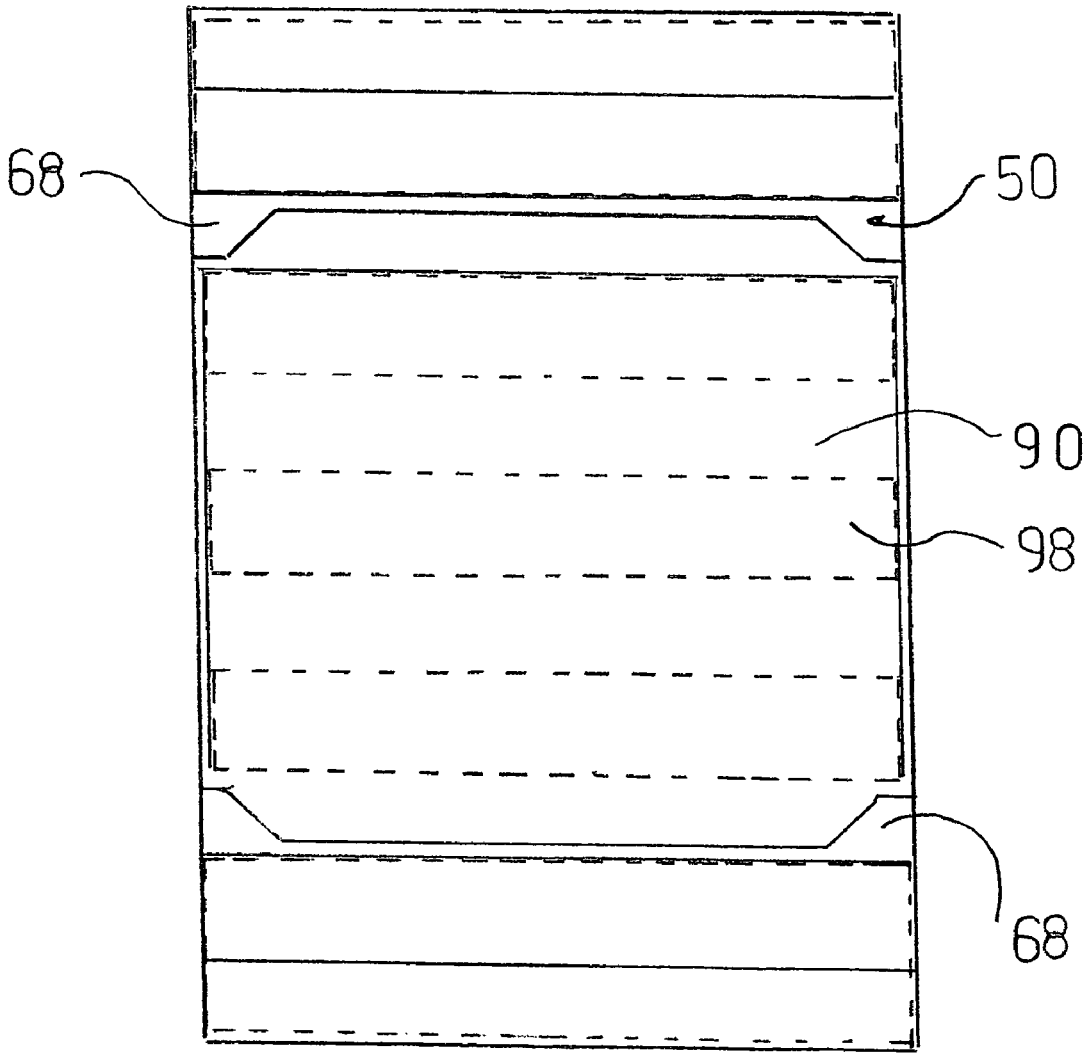
FIG. 2 is front view of the device. The platform is in place, with the resilient members being drawn in phantom.
Figure 3:
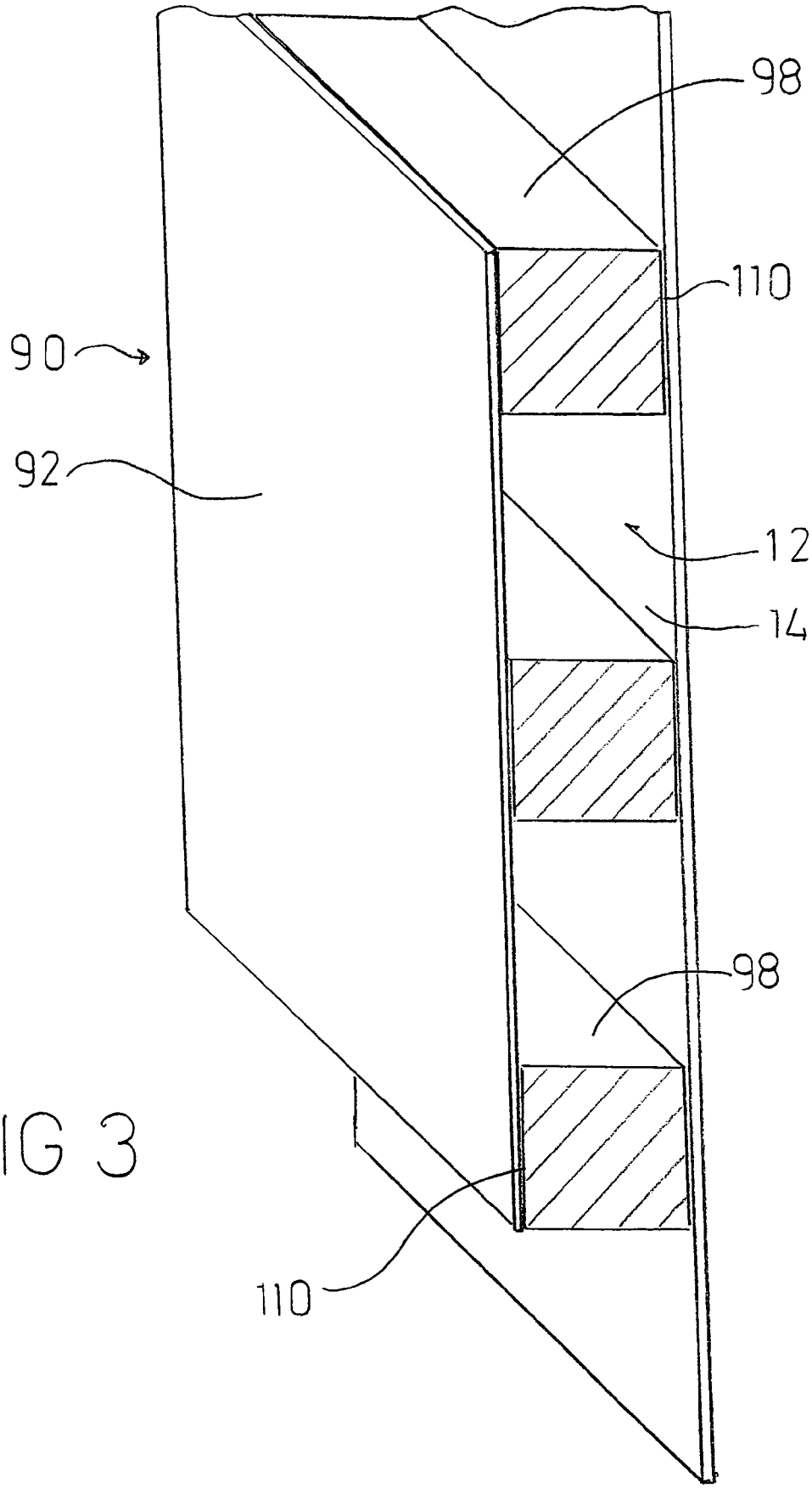
FIG. 3 is a view of the platform and resilient mount. The base plate is shown in part.
Figure 4:
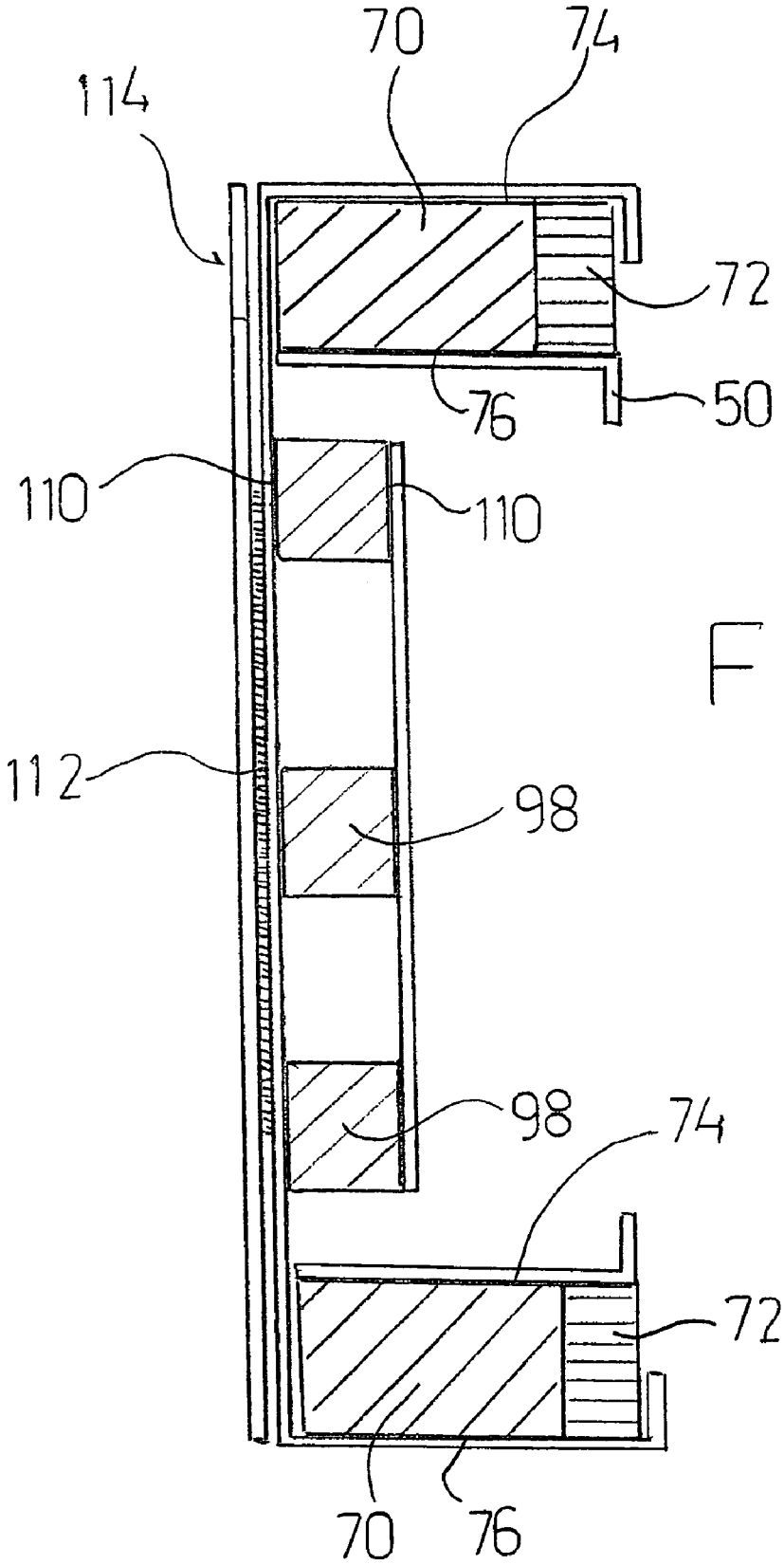
FIG. 4 is a cross sectional side view of the device, showing the relationship of the components. Note that there are two different resilient members between the contact plates and the base plate projections. The two different resilient members are contained as in the same construct as a single resilient member as is shown in FIG. 1.
Figure 5:
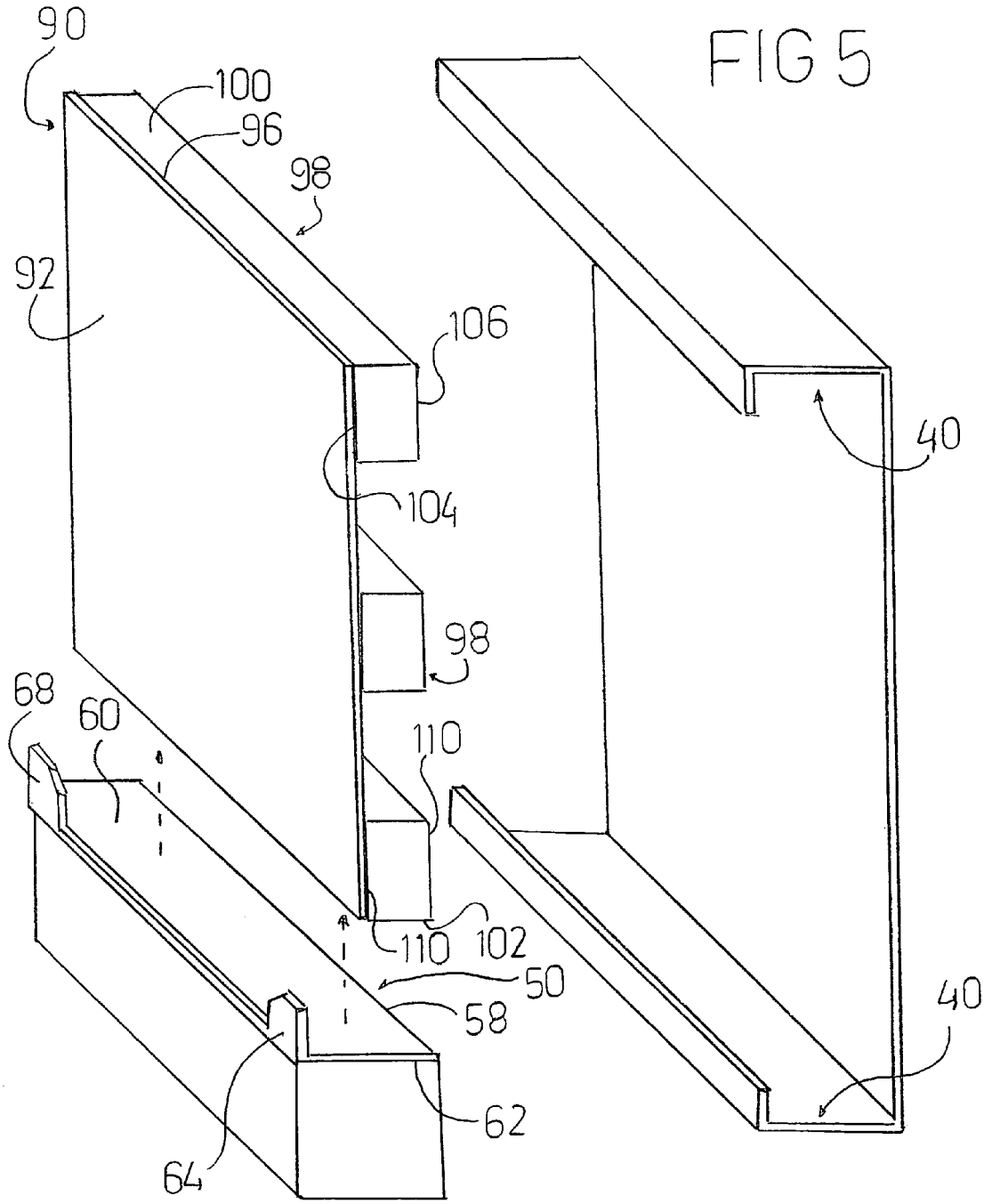
FIG. 5 is an exploded view of the base plate, platform and one of the contact plates. The resilient members are present, coupled to the platform and the contact plate.
Figure 6:
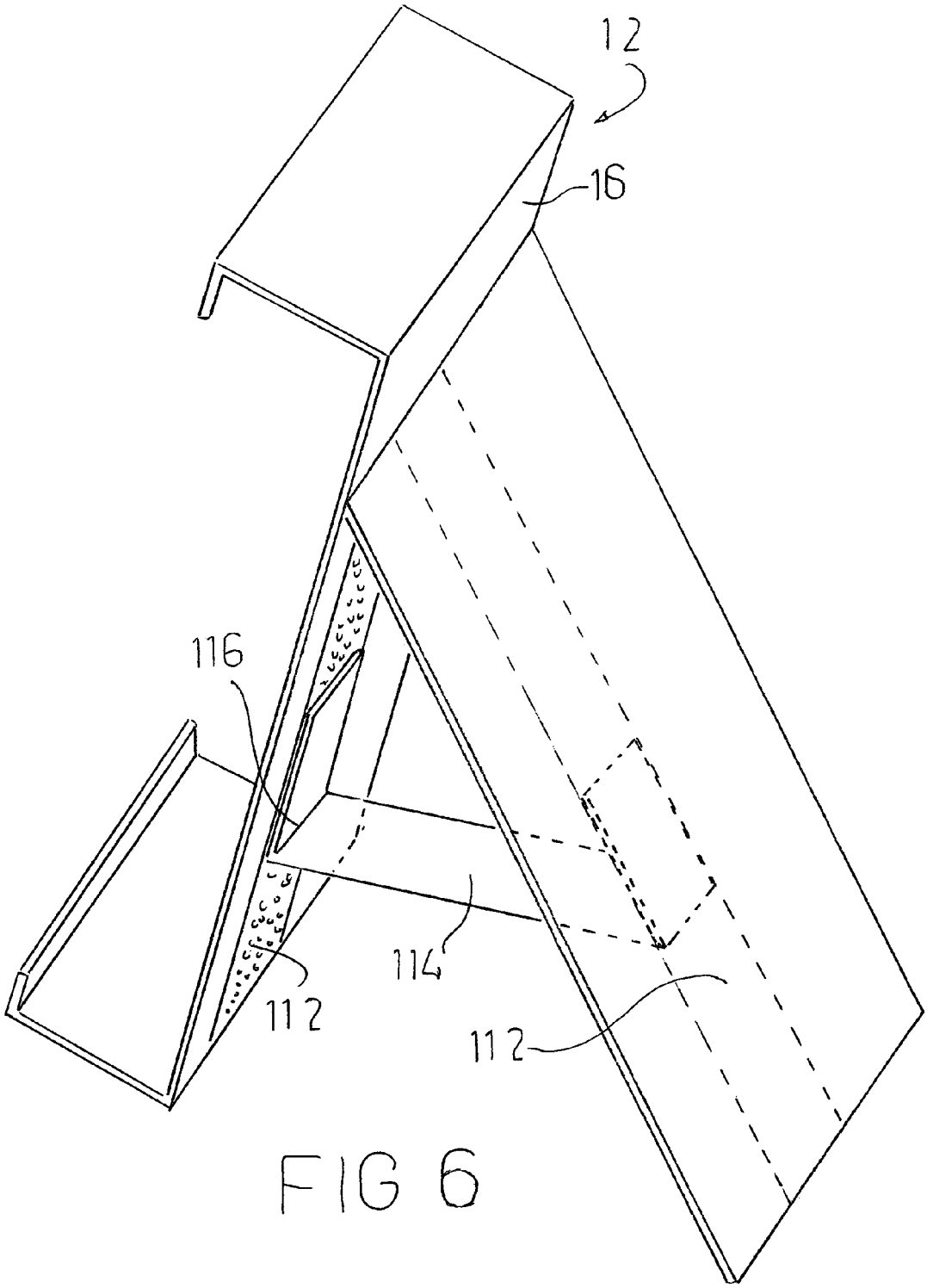
FIG. 6 is a perspective view of the rigid folded strip coupled to the rear surface of the base plate by a hook and loop fastener. The strip is folded and attached to the base plate at both ends, making a stand for the book holding device. One can see that the angle may be varied by the positioning of the rigid folded strip in relation to the base plate.

With reference now to the drawings, and in particular to FIG. 1 thereof, the preferred embodiment of the new and improved book holding device embodying the principles and concepts of the present invention and generally designated by the reference numeral 10 will be described.

The present invention, the book holding device 10 is comprised of a plurality of components. Such components in their broadest context include a base plate, a pair of contact plates, a platform and a plurality of compressible members. Such components are individually configured and correlated with respect to each other so as to attain the desired objective. A book holding device comprising several components, in combination. First provided is a base plate 12. The base plate is made of a rigid material. The base plate has a front side 14, a back side 16, an upper end 18, a lower end 20, two opposing side ends 22, and an intermediate planar area 24. There is a friction pad 25, made of a non-slip material, such as rubber, coupled to the edge of the base plate. The base plate has a generally rectilinear configuration with the upper end and the lower end. The ends of the base plate are generally mirror image configurations of the other. The base plate lies in a first plane, with the upper end and the lower end each having a right angled projection 30 there from. The right angled projection has a first height, a first length, and a first depth. The right angled projection lies in a plane generally perpendicular to the plane of the base plate. The right angled projections of the rear-ward end 32 and the forward end 34 each forward end having a inwardly turned lip 36. In the preferred embodiment the lip has a straight rectilinear configuration. In other embodiments, the lip may have a curvilinear or curved configuration. The projection functions to provide rigidity to the base plate structure and to form a coupling surface for other components.

The inwardly turned lips of the upper end and the lower end each forms a trough 40, with the upper lip forming an upper trough and the lower lip forming a lower trough between the inwardly turned lips. The base plate comprises the two troughs, with each trough having a first length, a first height, and a first depth. When viewed from the side the trough makes up the turned portions of the C-shaped configuration of the base plate. The dimension between the upward and downward extents of the troughs is between about six inches and eight inches. This distance allows the placement of a number of various sized books into the base plate. The size herein described is not the limit, but comports with the customarily found paperback books. One skilled in the art would recognize that the dimensions provided herein could be made larger or smaller, depending on the range of books one desired to have the base plate contain. The side to side dimension of the base plate is between about four inches and six inches. The distance between the inwardly turned lip and the base plate is between about two inches and four inches. This distance also allows the device to be used with a large variety of sized paperbacked and soft backed books.

Next provided is a pair of book contact plates 50. The book contact plates are an upper contact plate 52 and a lower contact plate 54. Each plate is fabricated of a rigid material and has a generally rectilinear configuration. Each contact plate lies in a plane parallel with the other contact plate and is perpendicular to the plane of the base plate. Each contact plate has a forward edge 56 and a rearward edge 58. The rearward edge of each of the contact plates is located adjacent the base plate intermediate area. The contact plates are oriented at about ninety degrees to the base plate. The book contact plates each have a first length and a second depth. The second depth is less than the first depth. Each contact plate lies inwardly of the right angled projections of the base plate. The contact plates each also have an upper surface 60 and a lower surface 62 and a peripheral edge. Each contact plate has a pair of protuberances. The lower contact plate has inwardly and upwardly oriented protuberances. The upper contact plate has an inwardly and downwardly oriented protuberances 68. The protuberances function to hold the pages of a book. The lower contact plate protuberances and upper contact plate protuberances are similarly configured and have a pair of end protuberances that are generally parallel with the plane of the intermediate area of the base plate. The contact plates are configured to be movable in an up and down direction, so that the contact plate can move into the trough of the C-shaped base plate, or away from the trough.

Next provided is a pair of resilient compression end members 70. In an another embodiment there may be a second compression end member made of a different compressible material 72. The compression end members are made of a flexible, compressible, resilient material. In the preferred embodiment the compression end members are made of a compressible, flexible foam. Other materials that allow the compression of the material, and return to form, may be used in place of the foam that is used in the preferred embodiment. The compression end members each have a generally rectangular cylindrical configuration with a first length, a second depth, and a second height. The second height is greater than the first height. Each end member has an upper surface 74, a lower surface 76, a pair of parallel side surfaces, and a pair of generally parallel end surfaces. The compression end members are coupled to each of the contact plates and oppositely coupled to each of the troughs of the C-shaped base plate. This configuration allows the compression members to be compressed, allowing the contact plates to move toward the troughs of the base plate. This allows the distance between the contact plates to increase as the compression end members are compressed between the trough and the contact plate. This variable and changeable distance allows the device to accommodate a large variety of differently sized books. The device clasps the book, and holds the book firmly, while allowing pages to be turned.

Next provided is an adhesive layer 80. The adhesive layer couples the resilient compression end members and the angled projection of the base plate in the are of the trough.

Next provided is a platform 90. The platform is fabricated of a rigid material and has a generally flat, planar configuration. The platform has a front surface 92, a rear, or back, surface 94, and a thickness there between forming a peripheral edge 96 around the extents of the platform. The platform is sized to fit within the intermediate area of the base plate.

Next provided is a plurality of resilient compression platform mount members 98. The platform mount members each have a generally rectangular cylindrical configuration with a first length, a first width, and a third depth. The third depth is less than the second depth. Each platform mount member has an upper surface 100, a lower surface 102, a front surface 104, a rear surface 106, and a pair of generally parallel side surfaces. The resilient compression platform mount members are coupled to the rear surface of the platform and oppositely coupled to the front face of the intermediate area of the base plate. This configuration allows the platform to be movable from a more front-ward position to a more rear-ward position. This movement is allowed by the compressibility of the resilient compression platform mount members. This configuration allows the book holding device to be able to accommodate books having various thicknesses. The resilient compression platform mount members also continue to bias the platform forward, which, when a book is in the device, presses the book against the protuberances of the contact plates, holding the book firmly in the device.

Next provided is an adhesive layer 110. The adhesive layer couples the rear surface of the resilient compression platform mount members to the front surface of the base plate. An adhesive layer also couples the front surfaces of the compression platform mount members to the rear surface of the platform.

A coupling means as herein use, may be an adhesive layer, clips, snaps, ties, and hook and loop devices.

Next provided is a patch 112 of hook and loop fastener. The preferred embodiment uses hook and loop fastener, but any of the above-listed coupling means may be used. The patch of hook and loop fastener is coupled to the rear surface of the base plate, in the intermediate area of the rear of the base plate.

Lastly provided is a folded strip 114 of rigid material having associated patches of hook and loop fastener. The folded strip is coupled to the strip of hook and loop fastener located on the rear of the base plate. The folded strip of rigid material acts as a stand or rest for the base plate. The folded strip has at least two folds 116. This construct allows the rigid folded strip to be coupled to the base plate at a first end, folded so as to make a stand, and folded again so as to allow the opposite, second end of the strip to contact with and couple with the base plate, making a stand for the book holding device. The folded strip has a plurality of patches of hook and loop material. Other means of coupling may be used, which include snaps, clips, wires, springs, and ties.

In use, a book is placed into the device by sliding the book along the L-shaped contact plates. The book is held in place and the book may be stored within the device. To open the book, one slides the book half way out of the device so that the binding is in the center of the device. The book is then opened and the pages pushed back, into the area of the contact plates with the book and pages being held in place by the protuberances. The protuberances of the contact plates hold the pages and the cover securely. The pages are turned by slipping the page from the holder and turning it, and reinserting the page within the holder on the opposite side of the binding by pressing the page into normal position. This may be carried out with one hand, and makes the device desirable for persons having the use of a single hand, or limited hand use, in general, such as in cases of advanced neurological disease, or severe arthritis. Because the device is constructed so as to have flat surfaces, the book may be stored open, to keep one's place, or to keep the book open on a counter top, such as done when using recipes from a cook book. The rigid folding strip on the rear surface of the base plate allows a user to create a stand, so that the book device may be held in a tilted, or angled, position. The multiple locations of hook and loop fastener on the rigid strip allow various configurations in creating a book device stand. This provides the added advantage of a user being able to custom make the angle for his or her own particular needs. A person sitting upright might desire the book to be angled so as to form an acute angle with a table top. A person lying down may wish the book to be held more upright. The device can be angled so as to provide a comfortable viewing angle no matter the angle of the surface the book holder is placed on.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A book holding device comprising:

a base plate;

a pair of book contact plates;

at least one resilient compression end member;

a platform having a generally flat planar configuration, the platform having a front surface and a back surface and a thickness there between forming a peripheral edge around the extents of the platform and at least one resilient compression platform mount member.

2. The book holding device as described in claim 1 wherein the device further comprises:

the base plate being having a front side and a back side and an upper end and a lower end and two opposing side ends and an intermediate planar area, the book contact plates being an upper contact plate and a lower contact plate, with each contact plate lying in a plane parallel with the other contact plate and perpendicular to the plane of the base plate and having the rearward edge of each of the contact plates being located adjacent the base plate intermediate planar area;

the resilient compression end member having a generally rectangular cylindrical configuration with an upper surface and a lower surface and a pair of parallel side surfaces and a pair of generally parallel end surfaces; and an adhesive layer coupling the rear surface of the resilient compression platform mount member and the base plate, and an adhesive layer coupling the front surfaces of the compression platform mount member and the platform.

3. The book holding device as described in claim 2 wherein the device further comprises:

the base plate having a generally rectilinear configuration with the upper end and the lower end being generally mirror image configurations of the other, the base plate lying in a first plane with the upper end and the lower end each having a right angled projection there from, the right angled projections of the upper end and the lower end each having a inwardly turned lip;

the book contact plates having a generally rectilinear configuration, the contact plates being oriented at about ninety degrees to the base plate, each contact plate lying inwardly of the right angled projections of the base plate, the contact plates each having a front end and a back end and an upper end and a lower end and a peripheral edge, each contact plate having a pair of inwardly angled protuberances, with the upper contact plate having an inwardly and downwardly oriented protuberances and the lower contact plate having an inwardly and upwardly oriented protuberances;

there being a plurality of resilient compression end members with each having a first length and a second depth and a second height, the second height being more than the first height;

the platform being sized to fit within the intermediate area of the base plate;

there being a plurality of resilient compression platform mount members with each having a generally rectangular cylindrical configuration, each platform mount member having an upper surface and a lower surface and a front surface and a rear surface and a pair of generally parallel side surfaces; and an adhesive layer coupling the resilient compression end members and the right angled projection of the base plate.

4. The book holding device as described in claim 3 wherein the device further comprises:

the base plate right made of a rigid material with the right angled projection having a first height and a first length and a first depth, the right angled projection lying in a plane generally perpendicular to the plane of the base plate, the inwardly turned lip of the upper end right angled projection forming an upper trough between the inwardly turned lip and the base plate with the upper trough having a first length and a first height and a first depth and an uppermost extent, the lower end right angled projection forming a lower trough between the inwardly turned lip and the base plate with the lower trough having a first length and a first height and a first depth and a downward-most extent;

the book contact plates being fabricated of a rigid material with the book contact plates each having a first length and a second depth with the second depth being less than the first depth, the lower contact plate protuberances and upper contact plate protuberances being similarly configured and lying in the plane generally parallel with the plane of the base plate;

the platform being fabricated of a rigid material; and the resilient compression mount members each having a first length and a first width and a third depth, with the third depth being less than the second depth.

5. The book holding device as described in claim 4 wherein the device further comprises:

the base plate therefore having a generally C-shaped configuration, the dimension between the upward and downward extents of the troughs is between about six inches and eight inches with the side to side dimension of the base plate being between about four inches and six inches and the distance between the inwardly turned lip and the base plate being between about two inches and four inches;

a strip of hook and loop fastener being coupled to the rear surface of the base plate in the intermediate area of the rear of the base plate; and a folded strip of rigid material having associated patches of hook and loop fastener being coupled to the rear of the base plate, the folded strip comprising a removably coupled stand for the book holding device.

6. A book holding device comprising:

a base plate having a front surface and a rear surface and a thickness there between;

a pair of book contact plates being movable and located on and front surface of the base plate;

at least one resilient compression end member coupled by a coupling means to each of the movable contact plates and to the base plate thereby coupling each of the contacts plates to the base plate;

a platform having a generally flat planar configuration, the platform having a front surface and a back surface and a thickness there between forming a peripheral edge around the extents of the platform; and at least one resilient compression platform mount member.

7. The book holding device as described in claim 6 wherein the device further comprises:

the base plate having a generally C-shaped configuration;

the contact plates each have a generally L-shaped configuration having a long leg and a short leg;

a coupling means coupling each compression end member to the base plate and to the contact plate.

8. The book holding device as described in claim 6 wherein the device further comprises the base plate having a pair of oppositely located projections; and the short leg of each of the contact plates has a pair of protuberances there from.

9. The book holding device as described in claim 8 wherein the device further comprises:

the base plate having a middle, with an intermediate area located around the middle of the base plate;

the contact plates being located adjacent the intermediate area of the base plate, and on opposing sides of the intermediate area, the protuberances of the contact plate being oriented in parallel with the base plate.

10. The book holding device as described in claim 6 wherein the device further comprises:

the base plate having a coupling means attached to the rear surface of the base plate;

a folded rigid strip having an associated plurality of patches of hook and loop means so as to form a support for the base plate.

11. A book holding device comprising:

a generally C-shaped base plate comprising a pair of base projections;

a pair of L-shaped contact plates;

a platform;

at least one resilient compression mount member coupling the platform to the base plate; and a plurality of compression end members coupling the contact plates to the base projection.

12. The book holding device as described in claim 11 wherein the device further comprises:

the base plate having a front and a rear;

a patch of hook and loop fastener coupled to the rear of the base plate; and a folded strip of rigid material having a plurality of patches of hook and loop fastener so as to allow the folded strip to be movably positioned on the rear of the base plate to form a stand for the base plate.

13. The book holding device as described in claim 12 wherein the folded strip is fixedly attached to the base plate.

14. The book holding device as described in claim 12 wherein the folded strip is removably attached to the base plate.

* * * * *